US007832473B2

(12) United States Patent
Pensgaard

(10) Patent No.: US 7,832,473 B2
(45) Date of Patent: Nov. 16, 2010

(54) METHOD FOR CONTROLLING THE FLOW OF FLUID BETWEEN A DOWNHOLE FORMATION AND A BASE PIPE

(75) Inventor: Rolf Emil Pensgaard, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 191 days.

(21) Appl. No.: 11/768,227

(22) Filed: Jun. 26, 2007

(65) Prior Publication Data

US 2008/0169099 A1 Jul. 17, 2008

Related U.S. Application Data

(60) Provisional application No. 60/884,940, filed on Jan. 15, 2007.

(51) Int. Cl.
*E21B 33/12* (2006.01)

(52) U.S. Cl. ..... 166/193; 166/229; 166/284

(58) Field of Classification Search ..... 166/236, 166/227, 284, 296, 193, 192, 229
See application file for complete search history.

(56) References Cited

U.S. PATENT DOCUMENTS

| | | | | | |
|---|---|---|---|---|---|
| 4,858,691 | A * | 8/1989 | Ilfrey et al. | ..... | 166/278 |
| 4,893,676 | A * | 1/1990 | Hill | ..... | 166/280.1 |
| 5,253,709 | A * | 10/1993 | Kendrick et al. | ..... | 166/284 |
| 5,373,899 | A * | 12/1994 | Dore' et al. | ..... | 166/278 |
| 5,485,882 | A * | 1/1996 | Bailey et al. | ..... | 166/284 |
| 6,059,032 | A * | 5/2000 | Jones | ..... | 166/278 |
| 6,112,817 | A | 9/2000 | Voll | | |
| 6,161,622 | A * | 12/2000 | Robb et al. | ..... | 166/386 |
| 6,380,138 | B1 * | 4/2002 | Ischy et al. | ..... | 507/204 |
| 6,622,794 | B2 | 9/2003 | Zisk | | |
| 6,907,936 | B2 | 6/2005 | Fehr | | |
| 7,134,505 | B2 | 11/2006 | Fehr | | |
| 7,419,002 | B2 * | 9/2008 | Dybevik et al. | ..... | 166/205 |
| 2006/0048942 | A1 | 3/2006 | Moen | | |
| 2006/0076150 | A1 | 4/2006 | Coronado | | |
| 2006/0113089 | A1 | 6/2006 | Henriksen | | |
| 2006/0118296 | A1 | 6/2006 | Dybevik | | |
| 2008/0041580 | A1 * | 2/2008 | Freyer et al. | ..... | 166/193 |
| 2008/0041581 | A1 * | 2/2008 | Richards | ..... | 166/193 |

FOREIGN PATENT DOCUMENTS

WO 2002075110 9/2002

* cited by examiner

*Primary Examiner*—Kenneth Thompson
*Assistant Examiner*—Catherine Loikith
(74) *Attorney, Agent, or Firm*—David G. Matthews; Rodney V. Warfford; Kevin B. McGoff

(57) ABSTRACT

A method is disclosed for controlling the flow of fluid between a downhole formation and a base pipe located in wellbore proximate the downhole formation. A plurality of chokes are established between the formation and the base pipe to regulate the flow of fluid between the formation and the base pipe. In one embodiment, each choke comprises a nozzle formed in the base pipe. In another embodiment, each choke comprises a nozzle in a housing arranged on the base pipe. A plurality of plugs are pumped downhole for engagement with the nozzles. The pressure in the wellbore is then increased until the plugs engage each nozzle. In an alternative embodiment, plugs are pumped downhole and stop up the housing containing the nozzles. Fluid flow between the base pipe and the downhole formation may be reestablished by dissolving the plugs or by back-flowing the production string to dislodge them.

20 Claims, 4 Drawing Sheets

METHOD FOR CONTROLLING THE FLOW OF FLUID BETWEEN A DOWNHOLE FORMATION AND A BASE PIPE

CROSS-REFERENCE TO RELATED APPLICATION

The present application claims the benefit of the filing date of U.S. Provisional Patent Application No. 60/884,940 filed Jan. 15, 2007.

BACKGROUND OF THE INVENTION

1. Field of the Invention

The present invention relates generally to a system for controlling the flow of fluid between a subterranean reservoir and a base pipe, and includes a method for killing production fluid flow in a subterranean well by blocking the flow of production fluid into the base pipe.

2. Description of Related Art

In general, to prevent uneven rate of fluid flow from multiple zones of a well into a production string (e.g., into a production tubing via a sand screen assembly), one or more inflow control devices ("ICD" or "ICDs") may be employed to appropriately choke, restrict, or open communication between the well annulus and the production string at each zone. In this way, the reservoir fluids obtain equal or nearly equal radial inflow rate. One system for achieving such results is described in U.S. Patent Application Publication No. 2006/0118296, which is incorporated herein by reference. Another system for achieving such results is described in U.S. Patent Application Publication No. 2006/0048942 ("the '942 application."), which is also incorporated herein by reference.

In well operations, it may at times become necessary not only to "kill" the well or otherwise shutoff production inflow into the production string, but also to reestablish the inflow of production fluid into the production string at a later time. It may also be necessary to control the injection of fluids from the production string into the formation. These novel results are realized by the method of the present invention.

SUMMARY OF THE INVENTION

In accordance with the present invention, a method is provided for controlling the flow of liquid between a downhole formation and a base pipe which is located in a production string in a wellbore proximate the downhole formation. A method according to the present invention comprises the step of establishing a plurality of chokes between the base pipe and the downhole formation to regulate the flow of fluid between the formation and the base pipe. A plurality of plugs are pumped downhole for engagement with the chokes. The pressure in the production string is then increased behind the plugs until the plugs engage the chokes to block the flow of fluid between the formation and the base pipe.

In one embodiment of the present invention, each choke is a nozzle which is formed in the base pipe, and one of the plugs directly engages a choke to block the flow of fluid through that choke. In yet another embodiment of the invention, each choke comprises a nozzle in a housing which is arranged on a base pipe, and a plurality of plugs that are pumped downhole are lodged in the housing to block the flow of fluid between the downhole formation and the base pipe.

In accordance with the present invention, the fluid which is flowing between the downhole formation and the base pipe is a production to fluid and each choke is adapted to regulate the production fluid. In yet another embodiment of the present invention, the fluid is an injection fluid and each choke is a nozzle adapted to regulate the injection fluid being injected into the downhole formation from the base pipe.

In accordance with the present invention, the plugs may be fabricated from a polymer material. In another embodiment, the plugs may be fabricated from a material that may be dissolved either over time or by using a chemical treatment.

The method according to the present invention may further comprise the step of reestablishing flow of production fluid from the formation into the base pipe and such reestablishment may be effected either by pumping a chemical downhole to dissolve the plugs or by back-flowing the production string to dislodge the plugs from engagement with the nozzles.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not limit the present invention.

Figure 1:
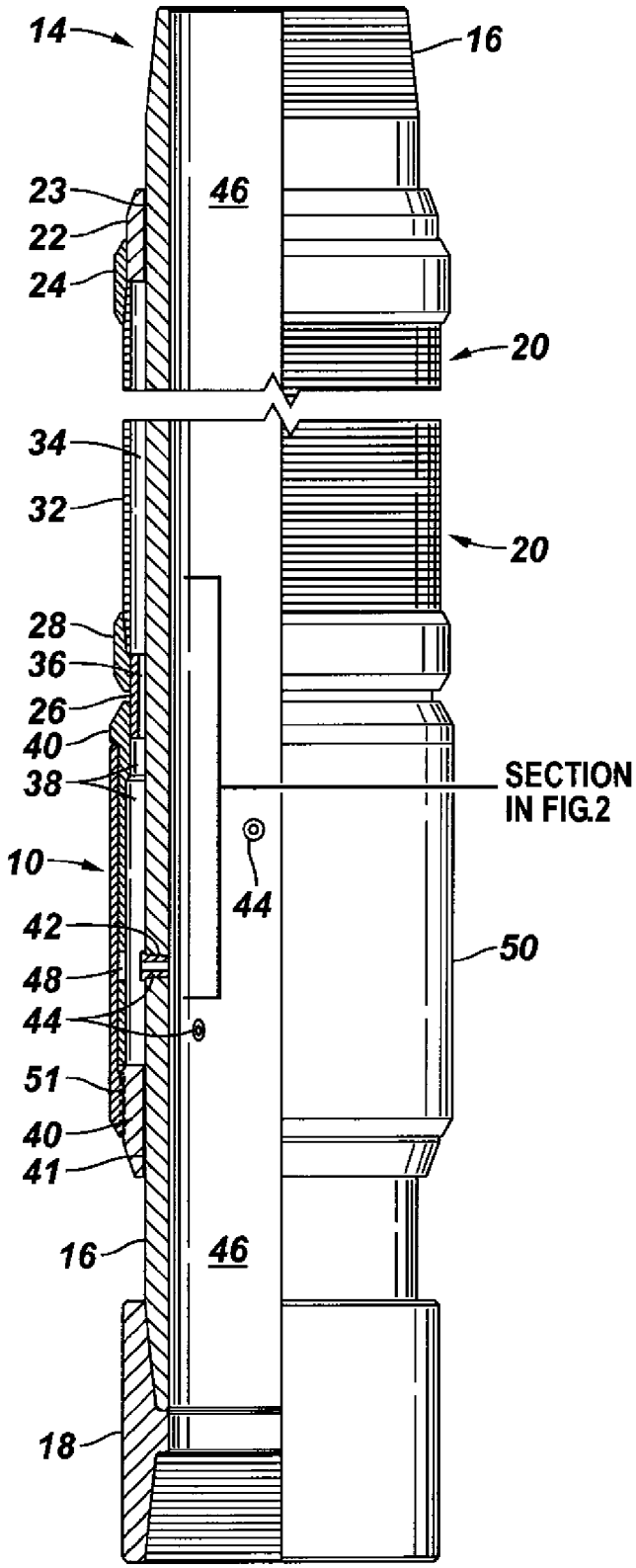
FIG. 1 is an elevation view in partial cross-section of a part of a pipe length of a production tubing containing an inflow control device.
Figure 2:
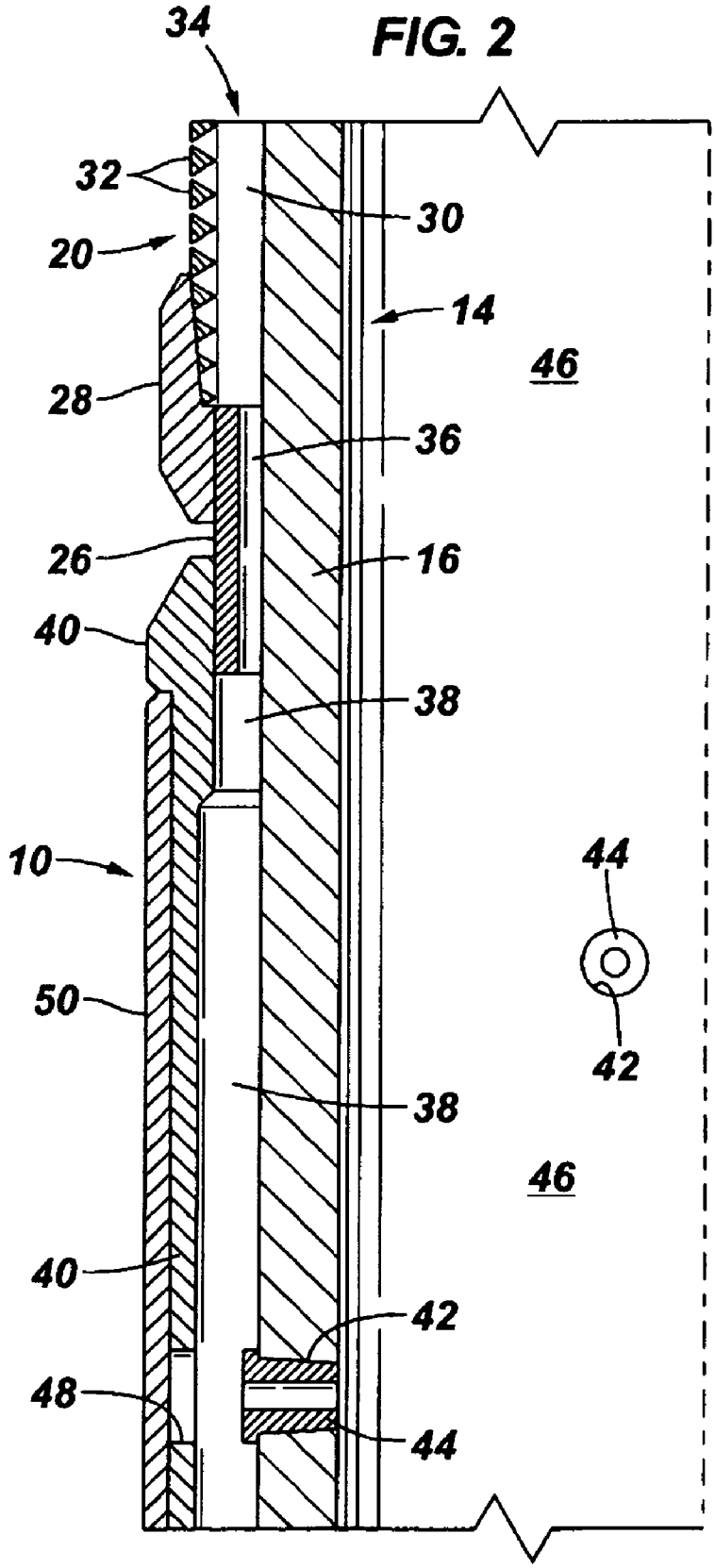
FIG. 2 is an enlarged portion of a section of FIG. 1.

As shown in FIGS. 1 and 2, an ICD may be provided to a pipe length 14 connected to other such pipe lengths (not shown), which together comprise a production tubing of a well. The pipe length 14 consists of a base pipe 16, each end thereof being threaded, thus allowing the pipe length 14 to be coupled to other such pipe lengths 14 via threaded pipe couplings 18. In this embodiments the base pipe 16 is provided with a sand screen 20 located upstream thereof. One end portion of the sand screen 20 is connected to the base pipe 16 by means of an inner end sleeve 22 fitted with an internal ring gasket 23 and an enclosing and outer end sleeve 24. By the flow control device 10, the other end portion of the sand screen 20 and a connecting sleeve 26 are firmly connected by means of an outer end sleeve 28. The sand screen 20 is provided with several spacer strips 30 secured to the outer periphery of the base pipe 16 at a mutually equidistant angular distance and running in the axial direction of the base pipe 16. Continuous and closely spaced wire windings 32 are wound onto the outside of the spacer strips 30 in a manner providing a small slot opening between each wire winding 32, through which slot openings the reservoir fluids may flow from the surrounding reservoir rocks. Thus several axial flow channels 34 exist along the outside of the pipe 16, these existing between successive and adjacent spacer strips 30 and also between the wire windings 32 and the pipe 16. Through these channels 34 reservoir fluids may flow onto and through the connecting sleeve 26. The connecting sleeve 26 also is formed with axial, but semi-circular, flow channels 36 that are equidistantly distributed along the circumference of the connecting sleeve 26. Through these channels 36 the fluids may flow onwards into the flow control device 10. It should be noted, however, that each individual axial flow channel 34, 36 is formed with a relatively large cross sectional area of flow. During fluid flow through the channels 34, 36, the flow friction and the associated fluid pressure loss thus will be minimized relative to the energy loss caused by the flow restrictions in the flow control device 10 located downstream thereof.

Still referring to FIGS. 1 and 2, reservoir fluids are flowing into an annulus 38 in the flow control device 10. The annulus 38 comprises of the cavity existing between the base pipe 16 and an enclosing and tubular housing 40 having circular cross section. The upstream end portion of the housing 40 encloses the connecting sleeve 26, while the downstream end portion of the housing 40 encloses the base pipe 16. In this embodiment the downstream end portion of the housing 40 is fitted with an internal ring gasket 41.

In accordance with the present invention a plurality of chokes are established between the downhole formation and the base pipe 16. In one embodiment, the choke is a nozzle formed in the base pipe. In this embodiment, a portion of the pipe 16 is in direct contact with the annulus 38 and, may be provided with several through-going and threaded insert bores 42 of identical bore diameter. A corresponding number of externally threaded and pervasively open nozzle inserts 44 (which may for example, be fabricated from ceramic) are removably placed in the insert bores 42. The nozzle inserts 44 may be of one specific internal nozzle diameter, or they may be of different internal nozzle diameters. All fluids flowing in through the sand screen 20 are led up to and through the nozzle inserts 44, after which they experience an energy loss and an associated pressure loss. The fluids then flow into the base pipe 16 and onwards in the internal bore 46 thereof. If no fluid flow is desired through one or more insert bores 42 in the flow control device 10, this/these insert bore(s) 42 may be provided with a threaded sealing plug insert (not shown).

In order to allow for fast placement or replacement of nozzle inserts 44 and/or sealing plug inserts in said insert bores 42, the housing 40 is provided with through-going access bores 48 that correspond in number and position to the insert bores 42 placed inside thereof. Nozzle inserts 44 and/or sealing plug inserts may be placed or replaced through these access bores 48 using a suitable tool. In this embodiment the access bores 48 are shown sealed from the external environment by means of a covering sleeve 50 removably, and preferably pressure-sealingly, placed at the outside of the tubular housing 40 and using a threaded connection 51. The pipe length 14 then may be connected to other pipes 14 to comprise continuous production tubing. In another embodiment, the nozzles may be formed on the base pipe by using milling techniques.

Figure 3:
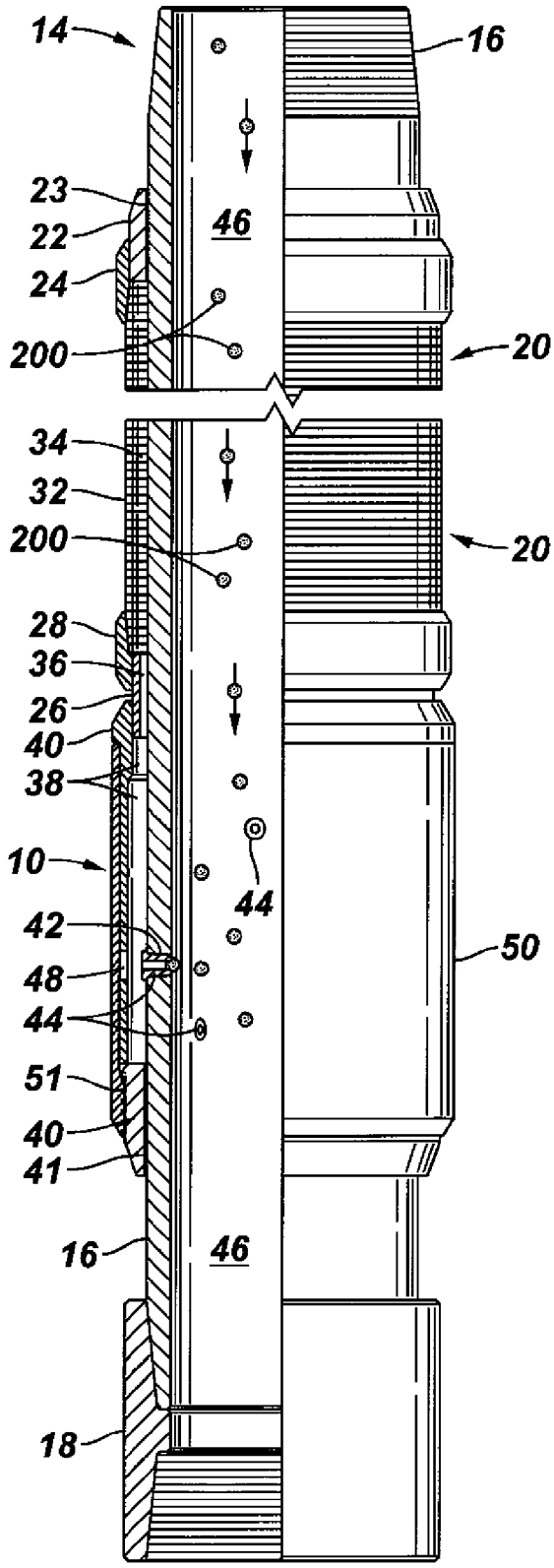
FIG. 3 is an elevation view in partial cross-section illustrating one embodiment of the present invention being utilized to shut off production flow in the structure illustrated in FIGS. 1 and 2.

Referring to FIG. 3, in embodiments such as those described in FIGS. 1 and 2, a selected number of plugs 200 may be pumped downhole (e.g., through well fluid medium) into a pipe length 14 at a target production zone. Fluid pressure is increased via the pump behind the plugs 200 until each nozzle 44 is engaged by a plug 200. At this point the pump operator at the surface should observe a pressure spike indicating that communication via the nozzles 44 of the ICD 10 in substantially interrupted, thus indicating that production inflow has been blocked and the well is killed.

The number of plugs 200 selected to be pumped downhole would generally need to be at least as many as the number of nozzles. In most operations, it would be prudent to pump more plugs than are needed to insure complete inflow prevention (i.e., to plug each and every nozzle).

The structure of FIGS. 1 and 2 may also be utilized to regulate the injection of injection fluid from the base pipe into the formation. In this embodiment, the chokes may also be implemented using nozzles. The injection of injection fluid may likewise be blocked by pumping a plurality of plugs downhole as described above.

"Injection fluid" as used in this application includes any fluid delivered to a well annulus to achieve a well formation. "Injection fluid" includes but is not limited to tracing fluid, acid, gel, foam or other stimulating fluid, treatment fluids, kill fluids, artificial lifting fluid (liquid or gas), corrosion-resistant fluid, single or dual density third, brine and diesel.

Figure 4:
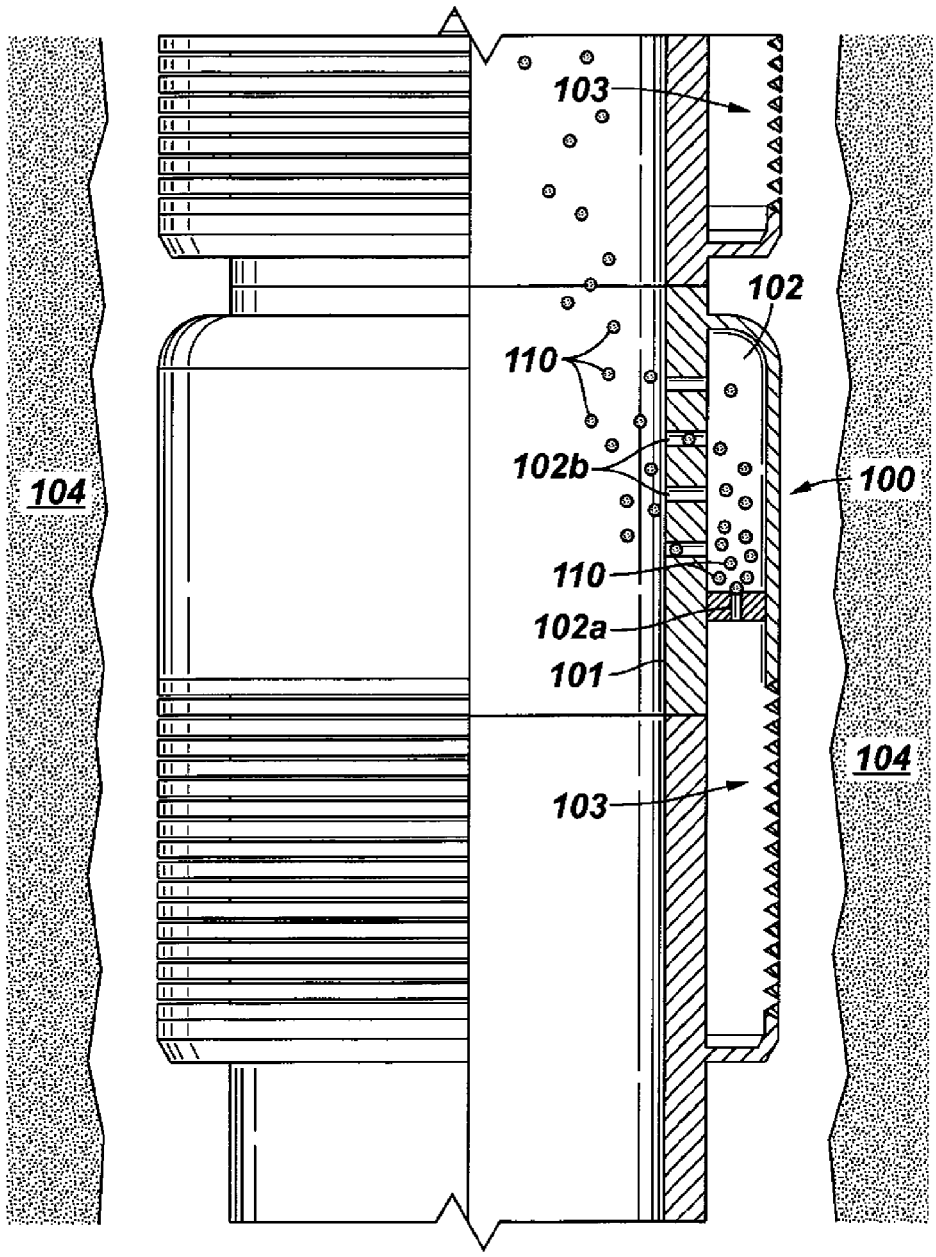
FIG. 4 is a side view in partial cross-section illustrating a second embodiment of the present invention being utilized to shut off production flow in a structure as disclosed in the '942 application.

With reference now to FIG. 4, in another embodiment, the choke may be formed in a housing arranged on the base pipe. In FIG. 4, the structure 100 is a part of the production tubing and includes a base pipe 101 with control chamber 102 which is located outside of base pipe 101. A choke is established in control chamber 102 and in an embodiment the choke comprises nozzle 102*a*. A sand screen 103 is provided and production fluid may flow from the formation 104 through sand screen 103 through a plurality of inflow control chambers 102 and into base pipe 101.

Still referring to FIG. 4, the flow of production fluid into base pipe 101 may be blocked by pumping a plurality of plugs 110 downhole (e.g., through the well fluid medium) into the base pipe 101 at a target production zone. The plugs 110, which are smaller in size than the plugs 200 of FIG. 3, enter the inflow control chamber 102 through the apertures 102*b* and stop up the nozzles 102*a* in the inflow control chambers 102.

The structure of FIG. 4 may also be utilized to inject an injection fluid from the base pipe into downhole formation as described above.

The plugs 110, 200 may be formed from any material mechanically, materially and chemically capable of engaging a nozzle and maintaining engagement in a well environment. In some embodiments, polymer plugs may be used. In other embodiments, plugs may be fabricated from a material that dissolves over time or in the presence of another chemical which may be injected/pumped into contact with the plugs to reachieve production flow. In other embodiments, the production string may be back flowed to dislodge the plugs from engagement with the nozzles.

It is intended that other embodiments of the present invention may be used to prevent production fluid flow via any ICD including, but not limited, to those ICDs comprising nozzles, ports, apertures, perforations, valves or other fluid metering devices.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for controlling the flow of fluid between a downhole formation and base pipe located in a production string in a wellbore proximate the downhole formation, comprising:

establishing a plurality of chokes between an interior of the base pipe and a surrounding sand screen to regulate the flow of fluid from the formation, through the sand screen and into the interior of the base pipe;

pumping a plurality of plugs downhole for engagement with the chokes; and increasing the pressure in the production string behind the plugs until the plugs are sufficiently gripped by the chokes to block fluid flow from the formation into the base pipe and to thus kill the well.

2. The method of claim 1, wherein each choke is a nozzle formed in the base pipe.

3. The method of claim 2, wherein a plug directly engages a choke to block the flow of fluid through that choke.

4. The method of claim 1, wherein each choke comprises a nozzle in a housing arranged on the base pipe.

5. The method of claim 4, wherein a plurality of the plugs that are pumped downhole are lodged in the housing to block the flow of fluid between the downhole formation and the base pipe.

6. The method of claim 1, wherein the fluid is a production fluid and each choke is adapted to regulate the production fluid flowing from the downhole formation into the base pipe.

7. The method of claim 1, wherein the fluid is an injection fluid and each choke is a nozzle adapted to regulate the injection fluid being injected into the downhole formation from the base pipe.

8. The method of claim 1, where the step of establishing each choke comprises:

forming a plurality of apertures in the base pipe; and installing a nozzle in each said aperture.

9. The method of claim 1, wherein the step of establishing each choke comprises forming it on the base pipe.

10. The method of claim 1, wherein the step of establishing each choke comprises:

forming a port in a housing arranged on the base pipe; and installing a nozzle in each port.

11. The method of claim 1, wherein the plugs are fabricated from a polymer material.

12. The method of claim 1, wherein the plugs are fabricated from a material that may be dissolved.

13. The method of claim 12, wherein the plugs are fabricated from a material that dissolves over time.

14. The method of claim 12, wherein the plugs are fabricated from a material that may be dissolved using a chemical treatment.

15. The method of claim 1, further comprising the step of reestablishing the flow of production fluid from the formation into the base pipe.

16. The method of claim 15, wherein the step of reestablishing the flow of production fluid comprises the step of dissolving the plugs.

17. The method of claim 16, wherein the step of dissolving the plugs comprises the step of pumping a chemical downhole to dissolve the plugs.

18. The method of claim 15, wherein the step of reestablishing the production flow comprises back-flowing the production string to dislodge the plugs from engagement with the nozzles.

19. A system for controlling the flow of fluid between a downhole formation and a base pipe, comprising:

a base pipe;

a sand screen disposed around at least a portion of the base pipe;

a plurality of chokes positioned along the base pipe within the sand screen to regulate flow of fluid between the downhole formation and an interior of the base pipe; and a plurality of plugs selected for engagement with the plurality of chokes, wherein the plurality of plugs is selectively forced into the plurality of chokes via pressure until the plurality of plugs is sufficiently gripped by the plurality of chokes to block fluid flow from the downhole formation to an interior of the base pipe.

20. The system has recited in claim 19, wherein the plurality of plugs is selectively dissolvable.

* * * * *